US006012321A

United States Patent [19]

Ito et al.

[11] Patent Number: 6,012,321

[45] **Date of Patent: *Jan. 11, 2000**

[54] DRIVING DEVICE FOR A PRESSING MACHINE

[75] Inventors: Shunitsu Ito, Ichinomiya; Hiroshi Kobayashi, Kani, both of Japan

[73] Assignee: Murata Kikai Kabushiki Kaisha, Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/931,440

[22] Filed: Sep. 16, 1997

Related U.S. Application Data

[63] Continuation of application No. 08/620,645, Mar. 22, 1996, abandoned.

[30] Foreign Application Priority Data

Apr. 12, 1995 [JP] Japan ..... 7-112475

[51] Int. Cl.[7] ..... B21J 9/18

[52] U.S. Cl. ..... 72/443; 72/451; 100/283

[58] Field of Search ..... 72/441, 443, 449, 72/451; 74/337, 335; 100/48, 49, 281, 283

[56] References Cited

U.S. PATENT DOCUMENTS

| | | | |
|---|---|---|---|
| 3,661,008 | 5/1972 | Richardson | 72/451 |
| 3,785,282 | 1/1974 | Kamelander | 72/451 |
| 3,919,876 | 11/1975 | Bakermans | 72/451 |
| 4,653,311 | 3/1987 | Tack, Jr. | 72/443 |
| 5,031,431 | 7/1991 | Naito | 72/443 |
| 5,079,489 | 1/1992 | Ishii | 72/405.01 |

*Primary Examiner*—Valencia Martin-Wallace
*Assistant Examiner*—John Paradiso
*Attorney, Agent, or Firm*—Armstrong, Westerman, Hattori, McLeland and Naughton

[57] ABSTRACT

A driving device for a pressing machine, particularly effective on a turret punch press, whereby both high speed processing at times of low load and high load processing at low speeds can be carried out even with a low output motor. A driving device for a press machine that transmits the rotation of a motor 12 to a press system 11 via a rotation transmission system 29 having a speed reduction gear 30, wherein a speed change gear 31 intervenes on the rotation transmission system 29. The speed change gear 31 is arranged on the input side of the speed reduction gear 30. The press system 11 is a system for exchanging a rotation movement to a linear movement, reciprocally driving the punch tool 4 and comprises the toggle system 8 and the crank system 13 or the like. With regard to control, a method 36 for exchanging the rotation transmission ratio of the speed change system 31 corresponding to the type of process is arranged.

3 Claims, 5 Drawing Sheets

DRIVING DEVICE FOR A PRESSING MACHINE

This application is a Continuation of application Ser. No. 08/620,645 filed Mar. 22, 1996, now abandoned.

FIELD OF THE INVENTION

The present invention relates to a driving device for a pressing machine applicable to punch press machine and other general press machines.

BACKGROUND OF THE INVENTION

Conventional mechanical punch presses transmit the rotation of a flywheel rotating at a fixed speed to a crank system via a clutch brake thus converting this to a up-down movement of a ram. The speed cannot be changed mid-stroke.

From the point of noise reduction and high speed punching, a control that changes the speed mid-stroke is desirable. In short, the noise during punch processing is reduced if the speed when the punch tool strikes the workpiece is slowed down. However, a reduction in stroke speed causes a delay in the cycle timing of the punch processing. As a result, it is desirable to have a control that slows the speed when the punch tool actually strikes the workpiece mid-stroke and raises the stroke speed at other times.

This kind of punch speed control has been realised in general by a hydraulic punch press but the cost is increased due to the hydraulics. Even with a mechanical punch press, punch speed control is possible if driven by a servomotor. However, torque by the rotation of a servomotor is insufficient for obtaining a direct punch force.

The present applicant previously developed a punch press driven by a servomotor via a toggle system and also realised a mid-stroke speed change control on a mechanical punch press. On this punch press, the rotation speed of the servomotor reduces via a reduction gear the revolution count by, for example a tenth, and transmits the drive to the toggle system.

Moreover, according to this punch press, not only mid-stroke speed control but by using a revolution count which is widely changeable with a large output from the servomotor, everything from high speed processing of a large number of holes such as with nibbling processing to large hole processing having a large load can be realised by controlling the servomotor revolution count.

However, as the aforementioned servomotors with a large output and a wide range for changing the revolution count become extremely high quality, using them also greatly increases the cost. If a general servomotor has the specifications applicable to high speed processing, heavy load punch processing such as when the plate is thick, when large diameter holes are to be processed or when the material is hard, becomes impossible due to insufficient tonnage.

Conversely, if the servomotor has specifications for heavy load processing, high speed punching becomes unachievable. This kind of problem is not only limited to punch presses and occurs on other types of press machines.

SUMMARY OF THE INVENTION

It is a primary object of the present invention to propose a driving device for a pressing machine that, even with a low output motor, can carry out both high speed processing at times of light loads and high load processing at low speeds while suppressing the naise by speed contral.

It is another object of the present invention to prevent increases in machine size associated with attachment of a speed change means.

It is yet another object of the present invention to be able to automatically exchange between a high-speed low-load driving conditions and low-speed high-load driving conditions corresponding to the type of processing.

FIG. 1 corresponding to an embodiment of the structure of this invention will be explained.

On the driving device of this press machine which transmits the rotation of a motor 12 via a rotation transmission system 29 to a press system 11 that converts the rotational movement into a linear movement and reciprocally drives a punch tool 4, a speed change means 31 is introduced to the aforementioned rotation transmission system 29.

The aforementioned rotation transmission system 29 can also have a speed reduction means 30 aside from said speed change means 31 and in this case, that speed change means 31 should preferable be positioned on the input side of the aforementioned speed reduction means 30.

On the above structure, a process type specific exchange control means 36 can also be provided for exchanging the rotation transmission ratio of the above speed change means 31 corresponding to the type of processing.

The aforementioned press system 11 can also have a crank system 13 that converts a rotational movement from the aforementioned rotation transmission system 29 to a linear movement, and a toggle system 8 that increases the torque of the linear movement converted by the crank system 13 and causes the punch tool 4 to carry out a reciprocal movement.

The rotation of the servomotor 12 is transmitted to the press system 11 from the rotation transmission system 29 which is intervened by the speed change means 31 and a press processing is carried by the punch tool 4. When the rotation transmission ratio of the speed change means 31 is changed to a lower value, as the rotation of the servomotor 12 is reduced to a lower speed and transmitted to the press system 11, even if a low output is to be used on the servomotor 12, the processing speed is reduced but high load press processing can be carried out.

Conversely, when the rotation transmission ratio of the speed change means 31 is set at a high value, only low load processing can be carried out but high speed processing can be executed.

In this way, even by using a low output motor, both high-speed low-load processing and low-speed high-load processing can be carried out by changing the rotation transmission ratio of the speed change means 31.

When the rotation transmission system 29 has a speed reduction means 30, the rotation of the servomotor 12 is transmitted to the press system 11 as a rotation transmission ratio comprising the product of the speed reduction ratio from the speed reduction means 30 and the predetermined rotation transmission ratio from the speed change means 31, and press processing is carried out by the punch tool 4.

Thus when the rotation transmission ratio of the speed change means 31 is changed to a speed reduced state, as the rotation of the servomotor 12 is reduced in speed by both the speed reduction means 30 and the speed change means 31 and transmitted to the press system, even if a low output is used on the servomotor 12, the processing speed is reduced but high load press processing can be carried out.

Conversely, if the rotation transmission ratio of the speed change means 31 is set to, for example, 1:1 or a value bigger than this, only low load processing can be carried out but high speed processing can be executed. In this case, when the speed change means 31 is positioned on the input side of the speed reduction means 30, the rotation speed inside the speed change means 31 is high. However, as the rotation transmission force needs only be small, no large strength is demanded by the speed change means 31 and the speed change means 31 can manage being small.

When a control means 36 is arranged which exchanges the rotation transmission ratio of the speed change means 31, automatic exchange is carried out between the high-speed low-load drive state and the low-speed high-load drive state corresponding to the type of processing.

When the aforementioned press system 11 has a crank system 13 that converts a rotational movement from the aforementioned rotation transmission system 29 to a linear movement, and a toggle system 8 that increases a torque of the linear movement converted by the crank system 13 and causes the punch tool 4 to carry out a reciprocal movement, it is possible to offset the insufficient torque of the servomotor 12 and is sufficient to carry out punch processing.

DETAILED DESCRIPTION OF THE PREFERRED EMBODIMENT

Figure 1:
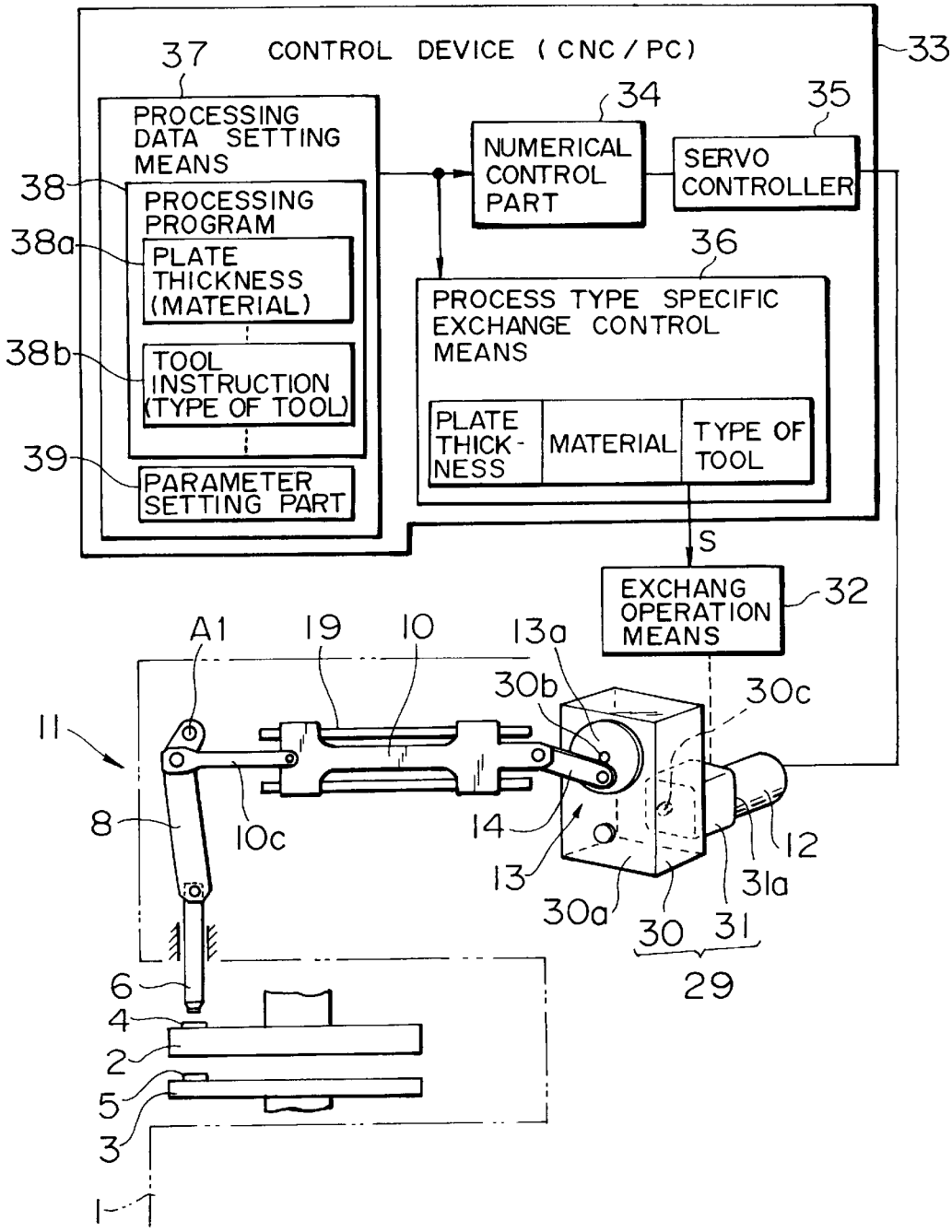
FIG. 1 is a descriptive diagram showing the general structure of the driving device of a pressing machine for one embodiment of the present invention.

An embodiment of the present invention will be described based on FIGS. 1 through 6.

The side view of a press frame 1 is "C" shaped and an upper turret 2 and lower turret 3 are positioned on the same axis on respectively an upper frame part 1*a* and a lower frame part 1*b* of that press frame 1.

A plurality of punch tools 4 and die tools 5 being the press are circularly arranged on respectively, the upper and lower turrets 2, 3. Each punch tool 4 is connected to a ram 6 and driven upwards and downwards when arriving at a ram position P.

The ram 6 is supported on the upper frame 1*a* via a guide member 7 so as to be freely raisable and is driven upwards and downwards by a toggle system 8 that carries out a flexing action. Two rams 6 are arranged lined up in the radial direction of the turrets 2, 3 in this embodiment and are selectively capable of transmitting the vertical action by the positioning system (not shown in the drawings). Consequently, the inner and outer ranks of punch tools 4 positioned on concentric turrets 2, 3 are selectively punch driven.

Plate member W (FIG. 4) is gripped by a workpiece holder 17 of the workpiece advancing system 20 and sends a table 18 to the ram position P.

Figure 2:
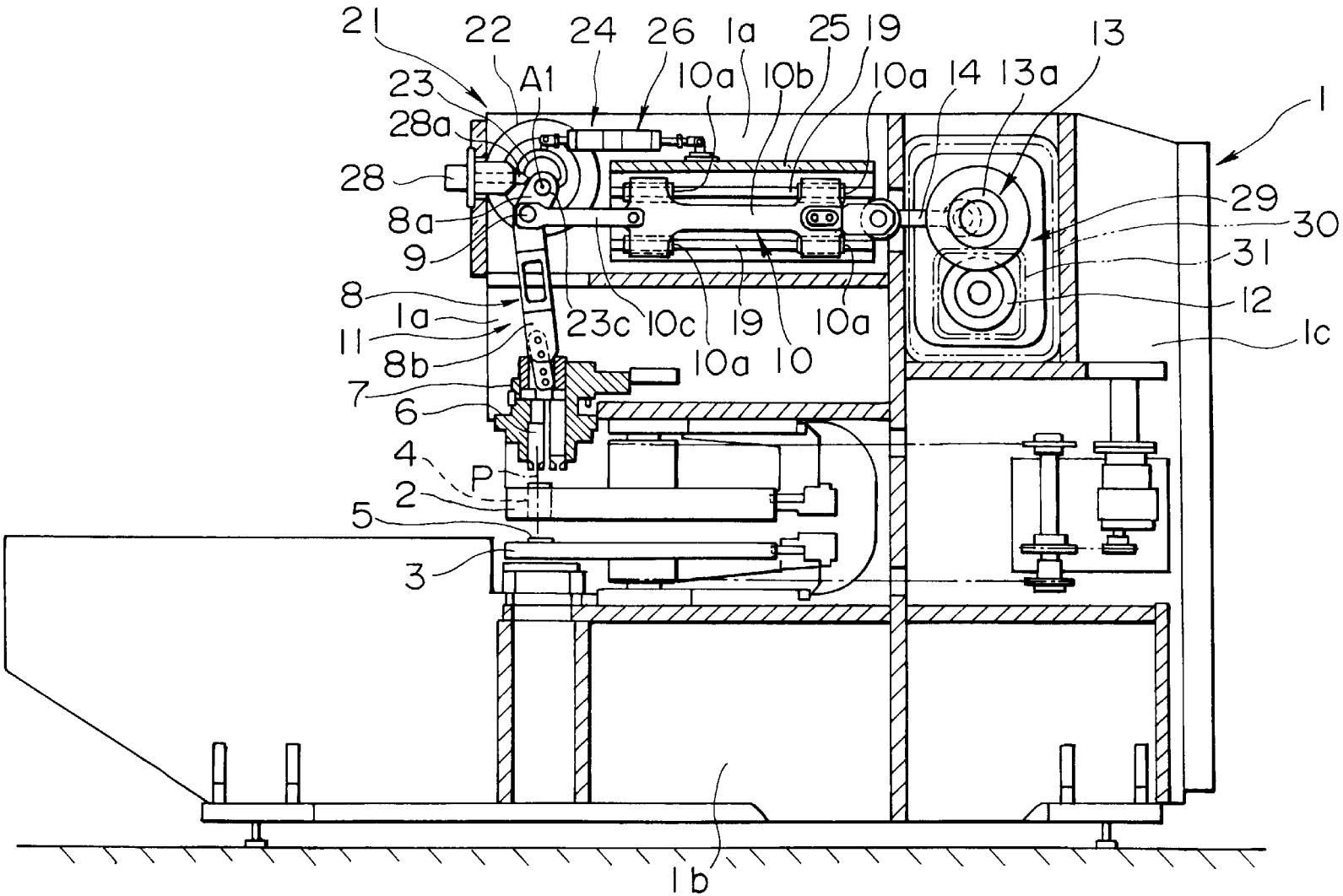
FIG. 2 is a broken side elevation of the toggle type punch press provided on the above driving device.
Figure 3:
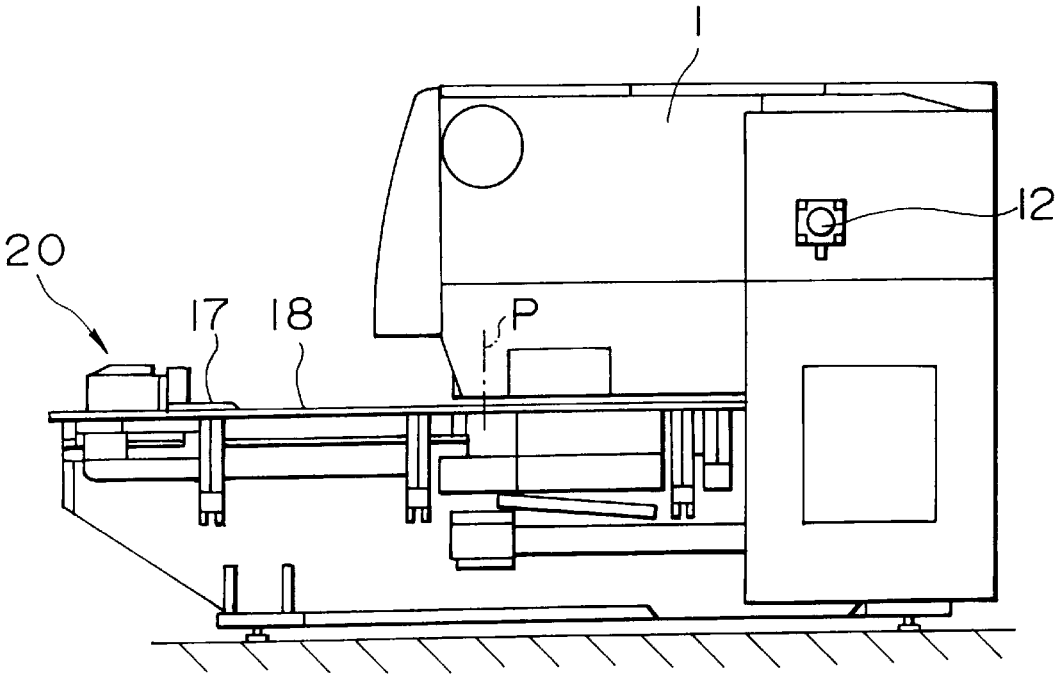
FIG. 3 is a side elevation of the above punch press.
Figure 4:
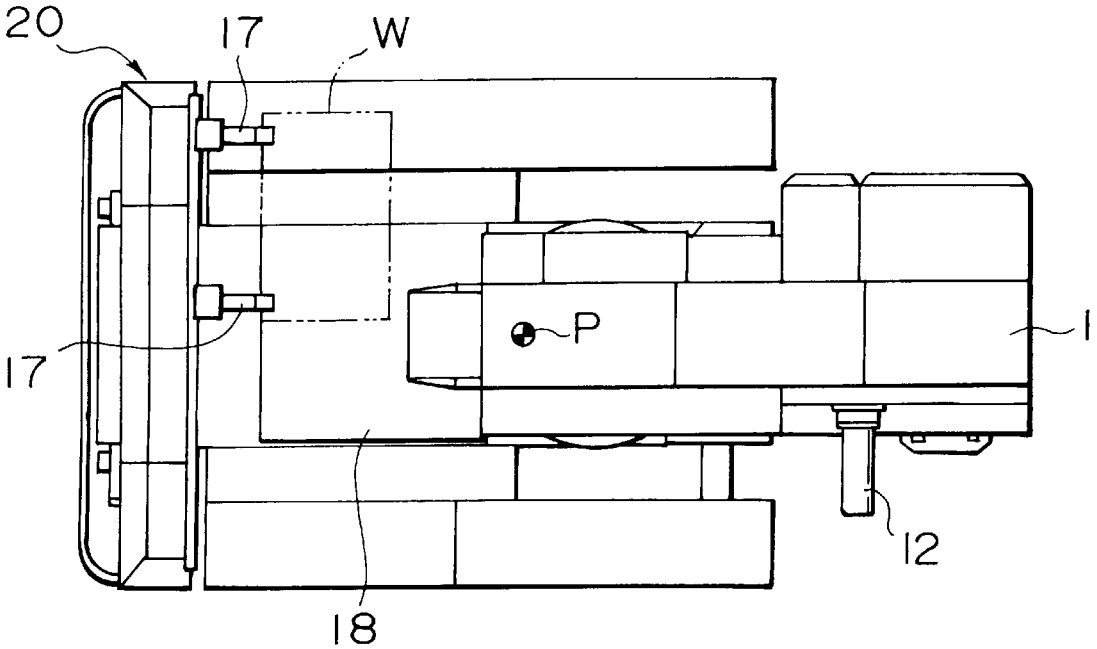
FIG. 4 is a top plan view of the above punch press.
Figure 5:
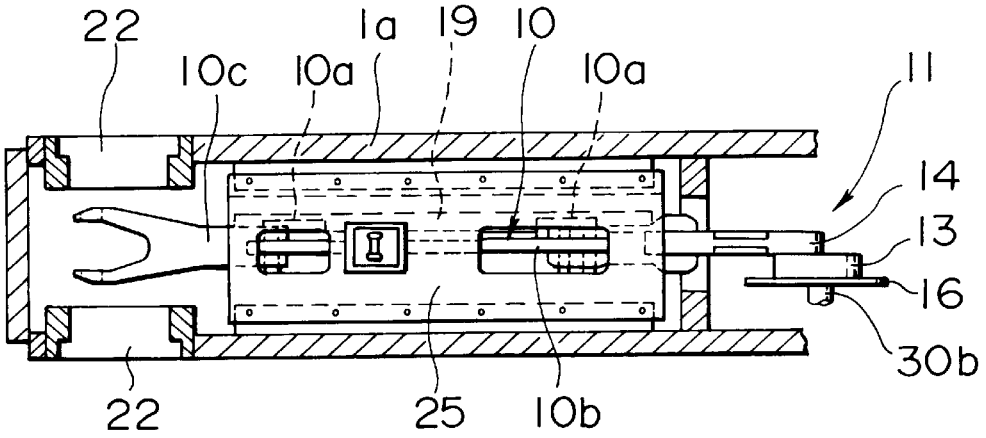
FIG. 5 is a partially broken top plan view of the press system of the above punch press.
Figure 6:
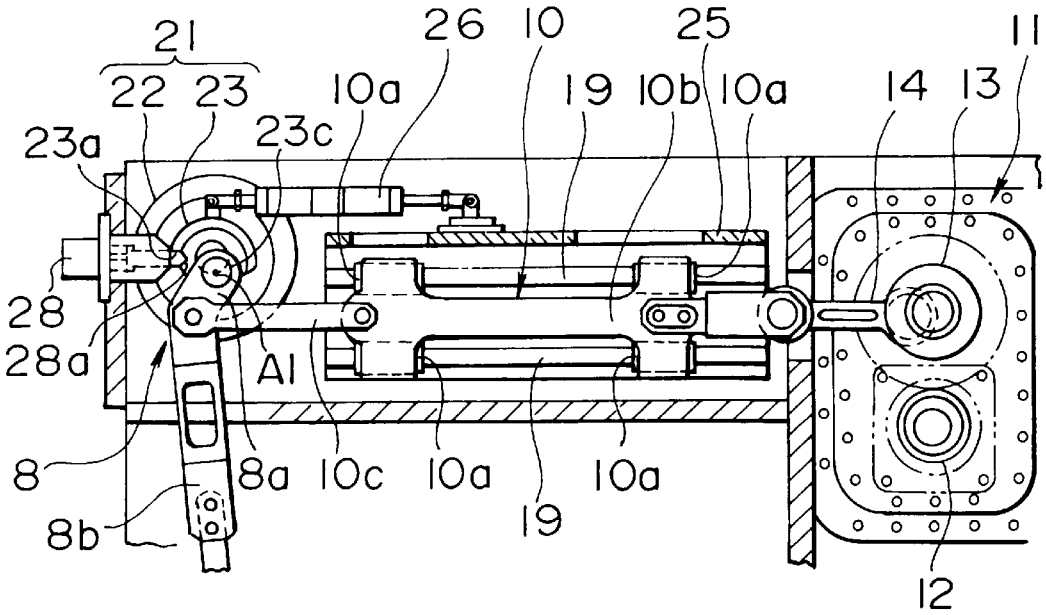
FIG. 6 is a vertical section of the press system shown in FIG. 5.

As shown in FIG. 2, the toggle system 8 is formed from the freely rotatable connection of a short, upper toggle link 8*a*, a long, lower toggle link 8*b* and a pin 9 and is driven by a retracting lever 10 which is retractable in the horizontal direction. The retracting lever 10 is retracted by a servomotor 12 via a crank system 13 and the rotation transmission system 29. Due to this toggle system 8, the retracting lever 10 and the crank system 13, the rotation of the motor 12 is converted into a linear movement and the press system 11 which raises the punch tools 4 is formed.

The lower end of the lower toggle link 8*b* of the toggle system 8 is coupled by a pin to the upper end of the ram 6 so as to be freely rotating. Rotating support point A1 of the upper toggle link 8*a* is supported by a point support means 21 so that the vertical positioning can be altered. The point support means 21 comprises the off-center member 23 of the circular shaft on which a pin 23*c* forming the rotating support point A1 is arranged off-center, a ring shaped rotating support member 22 which freely supports an off-center member 23 and a cylinder device 26 which causes the off-center member 23 to rotate. Also, a positioning cylinder 28 which connects a positioning pin 28*a* to a concave part 23*a* arranged around the circumference of the off-center member 23, is arranged against the off-center member 23.

The retracting lever 10 comprises the coupling of a swivel lever 10*c* on the tip of a retracting lever main body 10*b* so that it can freely rotate up and down and the tip of a swivel lever 10*c* which forms a two-pronged fork is connected to the flexing part of the toggle system 8 so that it freely rotates up and down. The up/down positional change of the flexing part in association with the flexing movement of the toggle system 8 is absorbed by the upward/downward swivelling of the aforementioned swivel lever 10*c*. The retracting lever main body 10*b* is supported so that it can retract freely via a guide member 10*a* along two guide rails 19, 19 positioned horizontally above and below in the center of the upper frame 1*a*.

The crank system 13 is arranged on the upper part of a column 1*c* of the frame 1 so that the axis of a disk shaped crank 13*a* points sideways, and connects one end of a connecting rod 14 to an off-center position of the crank 13*a*. The other end of the connecting rod 14 is connected to the base end of the retracting lever main body 10*b* and freely rotates.

The rotation transmission system 29 that transmits rotation from the servomotor 12 to the crank system 13 comprises the speed reduction gear 30 being a speed reduction means as shown in FIG. 1 and a speed change gear 31 being the speed change means. Further, in order to show details more clearly, FIG. 1 shows the disk shaped crank 13*a* and servomotor 12 reversed compared to other diagrams.

Speed reduction gear 30 contains the speed reduction gears inside a vertical gear box 30*a* and is attached to the press frame 1 by the front side (output side) of the gear box 30*a*. The speed reduction ratio is set to, for example, 1/10. The output shaft 30*b* of the speed reduction gear 30 projects from the front surface of the upper part and is attached to the aforementioned crank 13*a*. The input shaft 30*c* of the speed reduction gear 30 projects to the lower rear side of the gear box 30*a* and the output shaft (not shown in the drawings) of the speed change gear 31 is directly connected to this input shaft 30*c*.

The speed change gear 31 comprises a plurality of gears and a clutch etc in a casing 31*a* and, in this example, the rotation transmission ratio can be freely set to a reduction gear state and speed increase state by exchanging between, for example, four ratios such as 2/1, 1/1, 1/2 and 1/3. A fluid clutch or meshing clutch etc is used in the clutch of the speed change gear 31.

The speed change gear 31 is attached to the rear of the speed reduction gear 30 by the front of the casing 31*a* and has the output shaft on the front of the casing 31*a* and the input shaft on the rear. Furthermore, the speed change gear 31 need not only be gear style but can also use each type of system.

The servomotor 12 is attached to the rear of the casing 31*a* of the speed change gear 31 and directly connects the motor shaft to the input shaft of the speed change gear 31.

In addition, an exchange operation means 32 such as an electromagnetic type that optionally changes the value of the aforementioned four levels of the rotation transmission ratio by the input of an electric signal, is arranged on speed change gear 31.

In FIG. 1, a control device 33 is a means for controlling the entire punch press and provides a computer type numerical control part 34 and a programmable control part (not shown in the drawings). The numerical control part 34 executes a processing program 38 and outputs shaft advance orders to to the motor of each shaft of the servomotor 12 for the punch driver and a workpiece advancing system 20 (FIG. 4) as well as being a means for forwarding a sequence instruction of the processing program 38 to the programmable control part.

The punch drive instruction output from the numerical control part 34 is input into the servomotor 12 via a servocontroller 35. A parameter setting part 39 which memorises each kind of data necessary for processing except the processing program 38, is arranged in the control device 33 and a processing data setting means 37 comprises the processing program 38 and the parameter setting part 39.

In the control device 33 of this kind of basic structure, a process type specific exchange control means 36 is arranged in this embodiment. This means 36 is a means for exchanging the rotation transmission ratio of the speed change gear 31 corresponding to the type of processing. In reality, this means 36 outputs an exchange instruction S which chooses a predetermined rotation transmission ratio to the exchange operation means 32. The exchange operation means 32 replies to this instruction S and exchanges the speed change gear 31.

The process type specific exchange control means 36 is set with the predetermined process type data comprising the factors that have a large effect on the load of the punch process, such as plate thickness, material and type of tool. It carries out a comparison of the tool type for the plate thickness and material data 38*a* written in the process program 38 and a tool instruction 38*b* with said predetermined process type data and provides a function that selects the predetermined rotation transmission ratio of the speed change device 31 corresponding to the result of that comparison.

The data 38*a* of the plate thickness and material are generally written in every process program 38 but as the tool instruction 38*b* is multiply written in the process program 38, the process type specific exchange control means 36 carries out a selection of the above comparison and rotation transmission ratio every time the tool instruction 38*b* is read by the numerical control part 34. The plate thickness and material data 38*a* need not be written in the process program 38 and can be set in the parameter setting part 39.

The tool instruction 38*b* is an instruction that selects the type of punch tool 4 and is an instruction that calculates the rotation angle of turrets 2, 3. The type of punch tool 4 affects the size of the punched hole and as that size and in particular the peripheral length greatly affects the punch load, the type of punch tool 4 is set as a comparison element by the process type specific exchange means 36.

The actions of the above structure will now be described.

The rotation of the servomotor 12 is transmitted to the crank 13*a* via the speed change gear 31 and the reduction gear 30. When the crank 13*a* rotates once, the retracting lever 10 carries out one reciprocating retracting action. The toggle system 8 also carries out one reciprocal flex action but the ram 6 is positioned in bottom dead center at the extended state of the toggle system 8 and moves to the top dead center at both flexed states.

Due to this, the ram 6 repeats two rising actions for every one reciprocal motion of the retracting lever 10 and two punch actions are carried out by the punch tool 4. Furthermore, the toggle system 8 can also carry out a flexing action where it only moves to one side from the extended state.

Regarding this punch process, as the servomotor 12 acts as a drive source, control that changes the upwards-downwards speed of the punch tool 4 mid-stroke can be carried out. For example, control that lowers the speed when the punch tool 4 actually strikes the plate material W and speeds up the strike speed at other times, is possible. As a result, high speed punching can be carried out while suppressing the noise. The rotation of the servomotor 12 is greatly reduced in speed by the speed reduction gear 30 and converted to a vertical movement by the toggle system 8, therefore, even with the servomotor 12 being a drive source, an applied pressure necessary for punching can be obtained.

At times of punch processing when a light punch load process is to be carried out for processing multiple small holes or a plate material W of thin plate thickness, the rotation transmission ratio of the speed change gear 31 is set to 1/1 or 2/1. Due to this, high speed punch processing is carried out. In the case of thick plate thickness and large diameter hole processing, the rotation transmission ratio of the speed change gear 31 is set to 1/2 or 1/3. Due to this the punch action is carried out at a low speed but a large applied pressure can be applied to the ram 6 and even with the servomotor 12 of low output, a large diameter hole can be struck.

In this way, even by using the servomotor 12 of low output, both high-speed low-load processing and low-speed high-load processing can be carried out by changing the rotation transmission ratio of the speed change gear 31. The characteristics of the output of the servomotor 12 change depending on the rotation count. Exchange of high speed and high load processing is difficult simply by rotation count control of the servomotor 12 but by combining the servomotor 12 and speed change gear 31 in this way, highly efficient control can be executed.

The speed change gear 31 is arranged on the input side of the speed reduction gear 30 but as a result it has a high speed rotation amd small transmission force and can be small in size. Due to this, increases in size of the punch press associated with attachment of the speed change gear 31 are contained.

In accordance with execution of the processing program 38, the process type specific exchange control means 36 carries out a comparison for the change of the speed change gear 31 correponding to a punch load as described above when the tool instruction 38*b* is read and when necessary, outputs a change instruction. As a result, it is not necessary for the operator to judge the exchange, operation is easy and the above exchange can be realised automatically.

Furthermore, the process type specific exchange control means 36 can output an exchange instruction S in accordance with a predetermined instruction set in the processing program 38.

Figure 7:
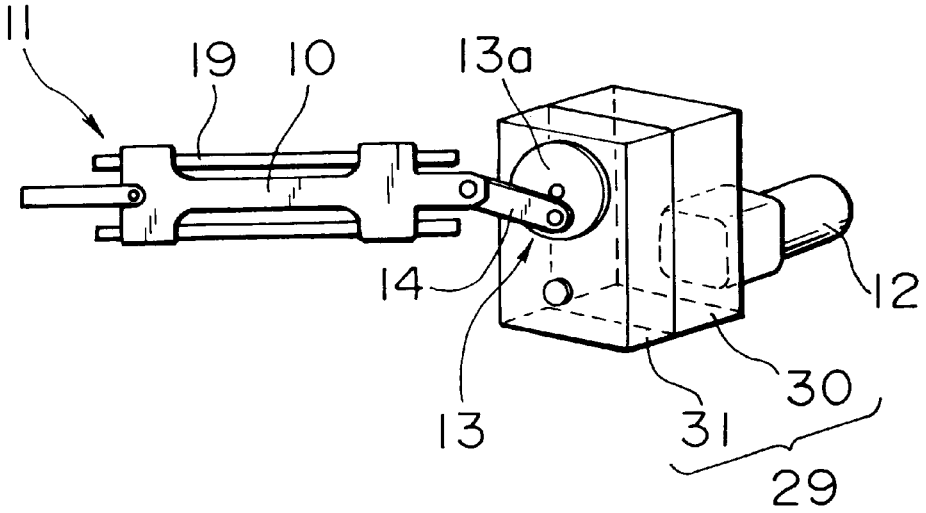
FIG. 7 is a structural description of the driving device of the press system for another embodiment of the present invention.

FIG. 7 shows an other embodiment of the present invention. This example has the speed change gear 31 coupled to the output side of the speed reduction gear 30 and has the crank 13*a* attached to the output shaft of the speed change gear 31. All other constructions are the same as the embodiment above. In this construction, the speed change gear 31 is of a larger size but as in the above case, both high-speed low-load processing and low-speed high-load processing can be carried out.

Figure 8:
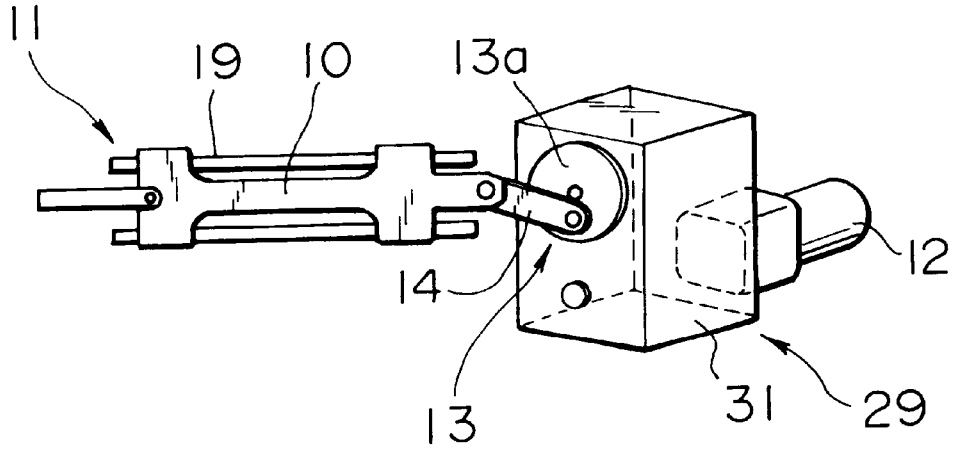
FIG. 8 is a structural description of the driving device of the press system for yet another embodiment of the present invention.

FIG. 8 shows yet another embodiment of the present invention. In the embodiment of FIG. 1, this example has no independent the speed reduction gear 30 and comprises a rotation transmission system 29 that transmits the rotation from the servomotor 12 to the crank system 13 by only the speed change gear 31 being a speed change means. The speed change gear 31 contains each system part inside a casing 31*a*.

In this system, in the case of a four step speed change in order to make the rotation transmission rate of the rotation transmission system 29 as a whole the same as the transmission rate of the embodiment of FIG. 1, the rotation transmission rate of the speed change gear 31 is set at the following four levels: 1/5, 1/10, 1/20 and 1/30. In short, in the embodiment of FIG. 1, as the rotation transmission rate of the speed reduction gear 30 is 1/10 and there are four levels (2/1, 1/1, 1/2 and 1/3) of rotation transmission rate of the speed change gear 31, the value of that product is the rotation transmission rate of the speed se gear 31 in the embodiment of FIG. 8.

In the case of this construction also, both low-load high-speed processing and low-speed high-load processing can be carried out. Furthermore, as the speed change gear 31 has speed reduction functions for the large speed reduction ratio and the structure parts are stored inside one casing 31*a*, the transmission system can become even more compact.

The above embodiment explained the situation when applied to a punch press but the present invention can be applied to press machines that carry out mold processing and other general press machines and are particularly effective for press machines that selectively need both high speed and high load processing depending on the type of process.

On a device that transmits the rotation of a servomotor to a press system via a transmission system, the drive device of the present invention can carry out both high speed processing with a low load and high load processing with a low speed even with a low output motor due to providing a speed change means on the above transmission system while suppressing the noise by speed contral.

Furthermore, the above transmission system has a speed reduction gear and as the speed change gear is arranged on the input side of the speed reduction gear, the speed change means need only be small and increases in size accompanying attachment of a speed reduction means can be prevented.

Yet further, due to the arrangement of a process specific exchange control means that changes the rotation transmission ratio of the speed change means corresponding to the type of process, automatic exchange between a high-speed low-load driving possible state and a low-speed high-load driving possible state can be carried out corresponding to the type of process thus making the operator's handling easy.

When the above press system has a crank system that converts a rotational movement from the above rotation transmission to a linear movement, and a toggle system that increases a torque of the linear movement converted by the crank system and causes the punch tool to carry out a reciprocal movement, it is possible to offset the insufficient torque of the servomotor and is sufficient to carry out punch processing.

What is claimed is:

1. A driving device for a pressing machine, comprising:

a press system that converts a rotational movement into a linear movement and causes a punch tool to carry out a reciprocating movement;

a rotation transmission system that transmits said rotational movement by a servomotor to said press system;

a variable transmission means arranged on said rotation transmission system, wherein said variable transmission means includes a plurality of rotation transmission ratios including at least a high rotation transmission ratio for low load processing and a low rotation transmission ratio for high load processing;

a process type specific exchange control means for exchanging a rotation transmission ratio of said variable transmission means corresponding to a type of processing based on a comparison between characteristics of a tool to be used in a process and predetermined data, wherein said process type specific exchange control means carries out, for each specific process type, a selection of a single transmission ratio among said plurality of rotation transmission ratios; and an exchange operation means, operably coupled to said variable transmission means and said process type specific exchange control means, for receiving electrical signals representing said single transmission ratio corresponding to said specific process type from said process type specific exchange control means, and for setting said variable transmission means to said single transmission ratio.

2. A driving device for a pressing machine as claimed in claim 1, wherein said rotation transmission means has a speed reduction means, and wherein said speed change means is positioned on an input side of said speed reduction means.

3. A driving device for a pressing machine as claimed in any one of claim 1 and claim 2, wherein said press system comprises a crank means for converting the rotational movement from said rotation transmission system to a linear movement, and a toggle means for increasing a torque of the linear movement converted by said crank means and for causing a punch tool to carry out a reciprocal movement.

* * * * *